US008348275B2

(12) United States Patent
Balogh et al.

(10) Patent No.: US 8,348,275 B2
(45) Date of Patent: Jan. 8, 2013

(54) MAIL-SORTING INSTALLATION WITH A PLURALITY OF OUTPUT MEANS, AND MAIL-SORTING METHODS

(75) Inventors: Zsolt Balogh, Weingarten (DE); Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/129,474

(22) PCT Filed: Nov. 11, 2009

(86) PCT No.: PCT/EP2009/064962

§ 371 (c)(1),
(2), (4) Date: Jul. 19, 2011

(87) PCT Pub. No.: WO2010/055047

PCT Pub. Date: May 20, 2010

(65) Prior Publication Data

US 2011/0260393 A1 Oct. 27, 2011

(30) Foreign Application Priority Data

Nov. 14, 2008 (DE) ..... 10 2008 057 408
Nov. 25, 2008 (DE) ..... 10 2008 058 843
Dec. 23, 2008 (DE) ..... 10 2008 062 843

(51) Int. Cl.
*B65H 39/10* (2006.01)
*B07C 5/00* (2006.01)

(52) U.S. Cl. ..... 271/300; 271/292; 209/630

(58) Field of Classification Search ..... 271/287, 271/292, 299, 300, 289, 290; 209/630, 704, 209/900

See application file for complete search history.

(56) References Cited

U.S. PATENT DOCUMENTS

| | | | | |
|---|---|---|---|---|
| 5,421,464 | A | 6/1995 | Gillmann et al. | |
| 5,441,252 | A * | 8/1995 | Hommes | 271/290 |
| 6,373,013 | B1 * | 4/2002 | Yamashita et al. | 209/584 |
| 6,634,639 | B2 | 10/2003 | Kuroda et al. | |
| 7,959,013 | B2 * | 6/2011 | Chifflet et al. | 211/10 |
| 2006/0202412 | A1 * | 9/2006 | Matsue et al. | 271/292 |
| 2010/0252488 | A1 * | 10/2010 | Balogh et al. | 209/509 |

FOREIGN PATENT DOCUMENTS

EP 0634957 B1 5/1997

* cited by examiner

*Primary Examiner* — Patrick Cicchino
(74) *Attorney, Agent, or Firm* — Laurence A. Greenberg; Werner H. Stemer; Ralph E. Locher

(57) ABSTRACT

A sorting system for sorting flat objects, particularly mail items, and a method for sorting such objects. The sorting system has a discharge device and an arrangement having at least two output devices. The output devices are arranged one behind the other as viewed in a longitudinal axis. The discharge device is designed to discharge each flat object to be sorted into one of the output devices in each case in such a way that the objects discharged into the same output device form a stack. Each output device has a bottom. The bottom of each output device rises with respect to the horizontal as viewed in a rising direction. An edge appears between the bottoms of two adjacent output devices. The edge slopes downward vertically or aslant as viewed in the rising direction.

14 Claims, 7 Drawing Sheets

MAIL-SORTING INSTALLATION WITH A PLURALITY OF OUTPUT MEANS, AND MAIL-SORTING METHODS

BACKGROUND OF THE INVENTION

Field of the Invention

The invention relates to a sorting installation for sorting flat articles, in particular items of mail, and to a method of sorting such articles.

An apparatus having the features of the preamble of independent claim directed to the sorting installation and a method having the features of the preamble of the main method claim are known from EP 634957 B1. A plurality of items of mail pass twice through the sorting installation described in EP 634957 B1. Once they have passed through the first time, the sorting installation discharges the items of mail into in each case one of a number of output device of the sorting installation. A conveying means transports the items of mail back to a feeding means of the sorting installation. This feeds the items of mail to the sorting installation for a second sorting sequence.

U.S. Pat. No. 6,634,639 B2 describes an apparatus for stacking upright articles, e.g. flat items of mail. The articles are transported in the upright state to an output means. This output means comprises a base ("bottom plate 2"), a fixed-location side wall ("side plate 3"), a guide element ("guide 5") and a supporting element ("support plate 4"). The supporting element 4 is fastened in a movable manner on a guide rail ("guide bar 6") of the side wall 3. The base 2 is inclined such that it slopes in the direction of the side wall 3. A single flat article for stacking is transported between the guide element 5 and the supporting element 4, to be precise by two endless conveying belts 81, 82. The article slides down the sloping base 2 until it strikes against the side wall 3. A stack of flat articles grows between the guide element 5 and the supporting element 4.

U.S. Pat. No. 6,501,041 B1 describes a sorting installation with an output means ("sortation mechanism 18"). This output means discharges an item of mail, in dependence on its delivery address, into a path which leads to a chute ("chute 28"). From there, the items of mail drop into a container ("container 30"). A conveying belt transports the filled containers back to a feeding means.

EP 1985380 A1 describes a system for handling mail containers. The containers are transported away from output means.

U.S. Pat. No. 7,080,739 B2 describes a sorting installation with a feeding means ("unit 5 for sorting and recognizing postal articles") and two horizontal rows of output means ("sort outlets 7 with bins 4"). The rows 6*a*, 6*b* are located obliquely one above the other.

BRIEF SUMMARY OF THE INVENTION

It is an object of the invention to provide an apparatus of the generic type, and a method of the generic type, able to retain a stack of discharged articles in the respective output device without the output device having to be separated from one another by side walls.

The object is achieved by an apparatus as claimed and by a method as claimed. Advantageous configurations are indicated in the dependent claims.

The sorting installation according to the solution is configured in order to sort flat articles. Each flat article extends in an article plane.

The sorting installation comprises a discharging apparatus and an arrangement with at least two output means.

The output means of the arrangement are arranged one behind the other—as seen along a longitudinal axis.

The discharging apparatus is configured in order for each flat article which is to be sorted to be discharged into in each case one of the output means of the arrangement. The discharging apparatus discharges the articles such that the articles discharged into the same output means form a stack. The discharging apparatus here discharges each article in the same stacking direction.

Each output means has a base. The base of each output means of the arrangement slopes up in relation to the horizontal—as seen in a direction of upward slope. The direction of upward slope is perpendicular to the stacking direction. The direction of upward slope runs parallel to the longitudinal axis.

There is an edge present between the bases of two adjacent output means of the arrangement. This edges slopes vertically or obliquely downward—as seen in the direction of upward slope.

The bases of the output means have a sawtooth-shape surface overall—as seen in the stacking direction—namely one saw tooth per output means. The contour of each saw tooth comprises a relatively long upwardly sloping region (formed by the base of an output means, which slopes up in the direction of upward slope) and a relatively short steeply or vertically downwardly sloping edge (transition between two output means). This edge prevents a stack from being displaced from one output means into an adjacent output means. This at least one edge does away with the need for separating two adjacent output means from one another by a side wall.

The flat articles in an output means are rotated by gravitational force and the inclined base of this output means, to be precise about an axis of rotation which is perpendicular to the planes of the articles and runs parallel to the stacking direction. The articles rotated in this way slide over the base, under the action of their weight, counter to the direction of upward slope until they strike against the edge of the adjacent output means. The articles are thus automatically aligned along two edges, namely along the lower edge and a side edge of each article, without side walls having to be provided for this purpose.

The apparatus according to the solution saves space, because there is no need for any side walls. Doing away with side walls makes it possible to achieve optionally at least one of the two following advantages:

- The series of output means requires less surface area ("footprint")—as seen along the longitudinal axis—than output means with side walls because a side wall inevitably has a thickness.
- Each individual output means can be widened—as seen perpendicularly to the stacking direction—that is to say it can receive wider articles, without the series of output means becoming longer—as seen along the longitudinal axis. This is achieved, in turn, because there is no need for any side walls, which have a thickness. A wider output means is able to receive a greater range of flat articles.

An existing sorting installation can be converted by using output means according to the solution, which do not have any side walls, to replace the existing output means, which still have side walls. There is no need for any further conversion work to the sorting installation. In particular, an existing discharging apparatus can continue to be used.

By virtue of the method according to the solution, a stack of flat articles can be transferred from an output means onto a conveying means without the stack having to be transferred, in the first instance, onto a separate work surface. The stack can be rotated. Even without the stack being transferred, it is possible to rotate the stack, e.g. to the extent where the stacking direction of the rotated stack is oriented parallel to the longitudinal axis (along which the output means extend) and each article plane is perpendicular to the longitudinal axis. The rotated stack is easier to transport than a stack which has not been rotated. Moreover, that article which was the first to be discharged is located at the front of the stack following transfer, which is often desirable.

Since there are no side walls present between the output compartments, the surface area which is formed by the bases can be used as a work surface. As soon as there is no longer any stack located in an output means, a stack which was discharged into the adjacent output means can be rotated in the direction of upward slope, and the bases of both output means are available for the purposes of rotation.

The base of at least one output means preferably has a scale-like surface in a sub-region. These scales make it difficult for an article to be displaced in the direction of upward slope. The edge and the scales therefore, together, secure an article in the output means.

The base of an output means preferably has a relatively steep and a relatively flat region, wherein the edge between the two regions runs perpendicularly to the direction of upward slope and parallel to the edge between the output means and the adjacent output means. This configuration makes it possible for flat articles to be oriented along the edge, because the relatively steep region causes the articles to slide against the edge. The respective center of gravity of an article is located above the relatively steep region, and therefore the articles rest of the relatively steep region, rather than on the relatively flat one. The relatively flat region reduces the height of the row of output means, which is frequently desirable.

The articles preferably pass through the sorting installation one after the other. The sorting installation measures, for each article, the value assumed by a predetermined feature for this article. The discharging apparatus discharges each article into one of the output means in dependence on the measured feature value.

Each article which is to be sorted extends in an article plane. The discharging apparatus discharges the articles preferably such that those articles which were discharged into the same output means form a stack. The stacking direction of this stack is perpendicular to the planes of the flat articles.

The invention will be described hereinbelow with reference to an exemplary embodiment. In the figures:

DESCRIPTION OF THE INVENTION

Figure 1:
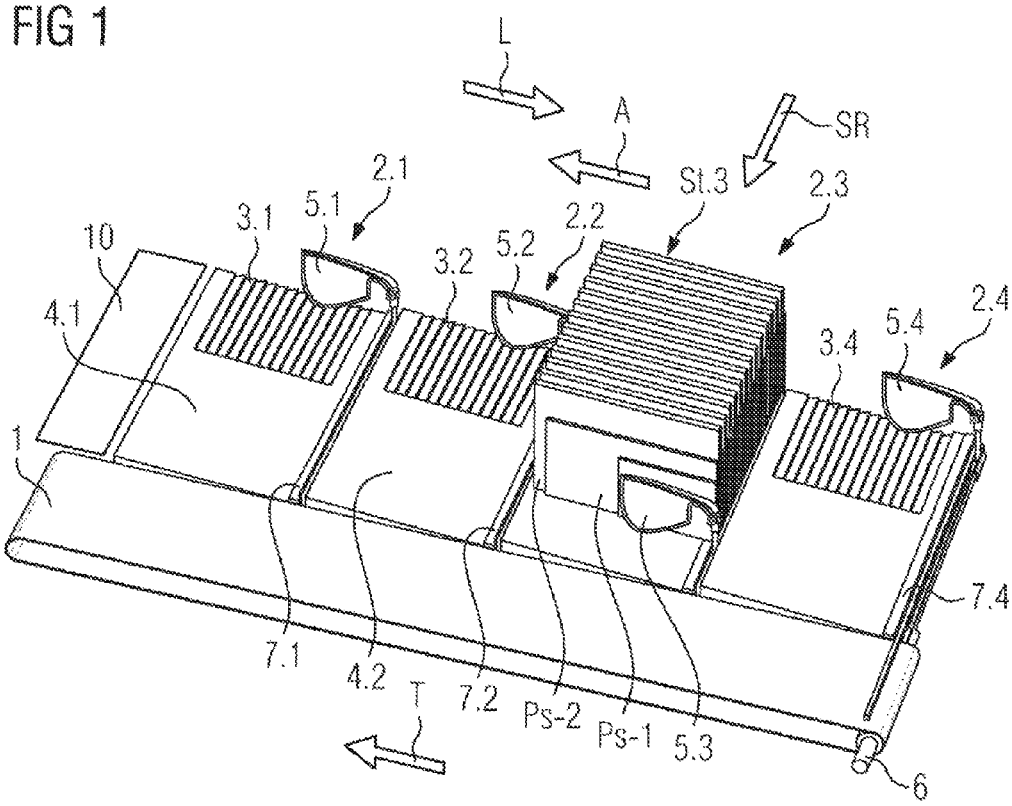
FIG. 1 shows four output means located in a row one beside the other.

In the exemplary embodiments, the sorting installation is used in order to sort flat items of mail (in particular standard letters, large letters, postcards and/or catalogues). Each item of mail extends in an article plane and has a front side and a rear side. One side of each item of mail bears information relating to a delivery address to which the item of mail is to be transported, to be precise in a form which can be read by a person and/or in the form of a bar code or of some other coding.

The sorting installation comprises the following constituent parts:

a feeding means ("feeder") with a separator,
a transporting means,
a reader,
a discharging apparatus,
a multiplicity of output means,
a conveying means, and
a machine controller.

A stack of items of mail which are to be sorted is fed to the feeding means. The items of mail stand upright during the feeding operation. A conveying belt of the feeding means transports the items of mail to the separator. This separator separates the stack of items of mail by successively withdrawing a respective item of mail from the stack. The separator thus creates a series of upright items of mail which are spaced apart from one another.

The transporting means transports the series of spaced-apart, upright items of mail through the sorting installation. The transporting means preferably comprises a system of a plurality of vertically arranged endless conveying belts, two of which in each case clamp an upright item of mail temporarily between them and rotate at the same speed.

During transportation, the items of mail pass the reader. The reader generates a respective digital image of that side of an item of mail on which the information relating to the delivery address can be found. The reader evaluates this image and attempts, in the first instance, to decipher the delivery address automatically, e.g. by Optical Character Recognition (OCR) or by bar code reading. If this is unsuccessful, then the image is displayed on a screen of a video coding station. An operator reads the delivery address and enters it into a keyboard or the like.

The machine controller evaluates a computer-available sorting plan. This sorting plan assigns a respective output means to each possible delivery address of an item of mail. The sorting plan thus establishes which items of mail with which delivery addresses should be discharged into which output means. In the exemplary embodiment, there are considerably more possible delivery addresses than output means, and therefore the sorting plan usually assigns a number of delivery addresses to one output means. It is possible for the sorting plan to reserve individual output means for just a single delivery address in each case because a large number of items of mail are directed to this delivery address. For example, one output means functions as an overflow compartment and a further output means functions as a compartment for items of mail which prove not to be machine-compatible.

The transporting means transports the item of mail further to the discharging apparatus. This discharging apparatus preferably comprises a series of diverters, namely in each case at least one diverter per output means. In each case one discharging path connects the transporting path to the output means. The diverter optionally deflects an item of mail into the discharging path or leaves the item of mail in the transporting path.

The actual transporting speed of each transporting path is measured. The machine controller thus "knows" at which point in time each item of mail is located at which location in the transporting means. Moreover, the machine controller "knows" the respective delivery address of each item of mail once the reader has deciphered this delivery address. The machine controller activates that diverter which connects the transporting path to that discharging path which leads to that output means into which the item of mail is to be discharged in accordance with the read delivery address and the sorting plan. The item of mail is discharged from the transporting path with the aid of the diverter and is transported on the discharging path to the output means.

The multiplicity of output means are arranged one behind the other—as seen along a longitudinal axis. In the exemplary embodiment, "longitudinal direction" denotes a direction parallel to the longitudinal axis and oriented away from the feeding means. It is possible for the output means to be provided in a number of rows and for the rows to be arranged vertically or obliquely one above the other. It is also possible for two rows of output means to be located in one plane and for the discharging apparatus to be located between the two rows of output means. Each row extends along the longitudinal direction L.

FIG. 1 shows four output means 2.1, 2.2, 2.3 and 2.4, which are located one beside the other, and a conveying belt 1. The four output means 2.1, 2.2, 2.3 and 2.4 shown extend one behind the other in a longitudinal direction L. The endless conveying belt 1 is configured in order to transport an article in the transporting direction T when the article is standing on the conveying belt, and it is guided, inter alia, around a guide roller 6.

Each output means 2.1, 2.2, etc. comprises a base. This base slopes up in relation to the horizontal—as seen in a direction of upward slope A. The base slopes up in relation to the horizontal, for example, at angle of 2 degrees to 4 degrees.

"Direction of upward slope" of an output means 2.1, 2.2, etc. is understood in the exemplary embodiment to mean a projection of a straight line or of a linear trace onto a horizontal plane. This straight line or this linear trace is located on the base of the output means 2.1, 2.2, etc. and runs parallel to the longitudinal axis L. The projection is achieved by a vertical projection which is also perpendicular to the longitudinal axis L.

In one embodiment, the direction of upward slope A runs parallel to the longitudinal direction L, that is to say likewise in the direction away from the feeding means. In an alternative embodiment, the direction of upward slope A runs counter to the longitudinal direction L and counter to the transporting direction T, that is to say in the direction of the feeding means. This alternative embodiment is shown, and indicated by an arrow A, in the figures.

In one configuration, the sorting installation has two rows of output means located vertically or obliquely one above the other. Such a sorting installation is described, for example, in U.S. Pat. No. 7,080,739 B2. It is possible for the bases of all the output means to be inclined in the manner just described.

It is also possible for just the bases of the lower row to be inclined and for the output means of the upper row to have planar bases and side walls. It is only the output means of the lower row which can be reached to the extent where their bases can be used as work surfaces for rotating a stack.

There is an edge present between the bases of in each case two adjacent output means. This edge slopes vertically or obliquely downward—as seen in the direction of upward slope A. The bases of the output means of one row thus have an upper termination edge which has a sawtooth-shaped contour—as seen in the direction perpendicular to the longitudinal direction L—namely in each case one saw tooth per output means.

The base, which slopes up in the direction of upward slope A, causes the items of mail to be rotated about an axis which runs parallel to the stacking direction SR and is perpendicular to the axis of each item of mail. The items of mail in an output means 2.1, 2.2, etc. thus slides down, counter to the direction of upward slope A, until they strike against the edge of the adjacent output means. The items of mail are thus aligned along their lower edges and along a lateral edge.

Each base preferably slopes up to precisely the same extent—as seen in the direction of upward slope A—as the following edge slopes down. This means that the bases of the output means 2.1, 2.2, etc. of one row are "on average" on the same level. It is also possible, however, for the output means to slope up or slope down "on average"—as seen in the longitudinal direction L.

In the exemplary embodiment, each base has a region 3.1, 3.2, etc. in which the surface looks like the scales of a fish or the tiles of a roof. In the exemplary embodiment, this scale-containing region 3.1, 3.2, etc. extends over the entire width of the base—as seen in the stacking direction SR. The steep edges of these scales or tiles are oriented in the direction counter to the direction of upward slope A. These scales or tiles are arranged so as to make it difficult for an article to be displaced in the direction of upward slope A.

In the example of FIG. 1, the four output means 2.1, 2.2, 2.3 and 2.4 shown each have a scale-containing region 3.1, 3.2, 3.3 and 3.4. These scale-containing regions make it difficult for an article to be displaced to the right in the direction of upward slope A. In the exemplary embodiment, a scale-free region 4.1, 4.2, etc. is located between the scale-containing region 3.1, 3.2, etc. and conveying means 1.

It can be seen in the figures that each base has in the first instance a scale-containing region 3.1, 3.2, 3.3 and 3.4, which is followed in each case by a scale-free region 4.1, 4.2, 4.3, 4.4—as seen in the stacking direction SR. As a result of this configuration the scales make it difficult for an item of mail to be displaced while the item of mail is being discharged. Once the item of mail has come into contact with the stack, in contrast, it is the friction between the items of mail in the stack which makes it difficult for an individual item of mail to be displaced.

Figure 2:
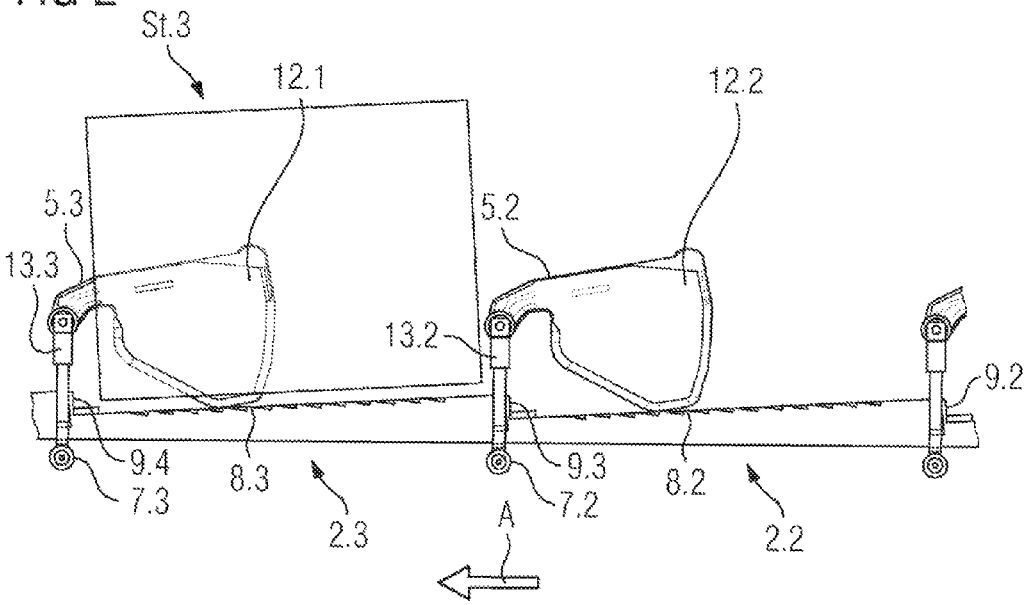
FIG. 2 shows two output means in cross section.

FIG. 2 shows the two output means 2.1 and 2.2 in cross section. The conveying belt 1 is located behind the two output means 2.2 and 2.3 illustrated—as seen in the viewing direction of FIG. 2. The scales on the bases of the two output means 2.2 and 2.3, inter alia the two scales 8.2 and 8.3, are illustrated. Also evident are the edge 9.2 between the adjacent output means 2.1 and 2.2 and the edge 9.3 between the adjacent output means 2.2 and 2.3.

A supporting component 5.3 is moved in the direction of the discharging apparatus, counter to the stacking direction SR, by a restoring component. The supporting component 5.3 thus supports a stack in the output means 2.3. The stack St.3 is located in front of the supporting component 5.3 of the output means 2.3—as seen in the viewing direction of FIG. 2.

The stacking direction SR is perpendicular to the drawing plane of FIG. 2, and the stack St.3 pushes the supporting component 5.3 in the direction of the conveying belt 1 and away from the viewer of FIG. 2.

In the embodiment which is shown in FIG. 2, the base of each output means forms a planar surface which has a scale-containing region. In a development of this configuration, the base of each output surface is subdivided into two regions which are located one behind the other as seen in the direction of upward slope A, that is to say are located one beside the other as seen in the stacking direction SR: a relatively steep region and a relatively flat region.

The edge between the output means and the adjacent output means is followed—as seen in the direction of upward slope A—in the first instance by a region which is inclined in relation to the horizontal to a relatively pronounced extent, and then by a region which is inclined to a less pronounced extent or is even horizontal.

Figure 3:
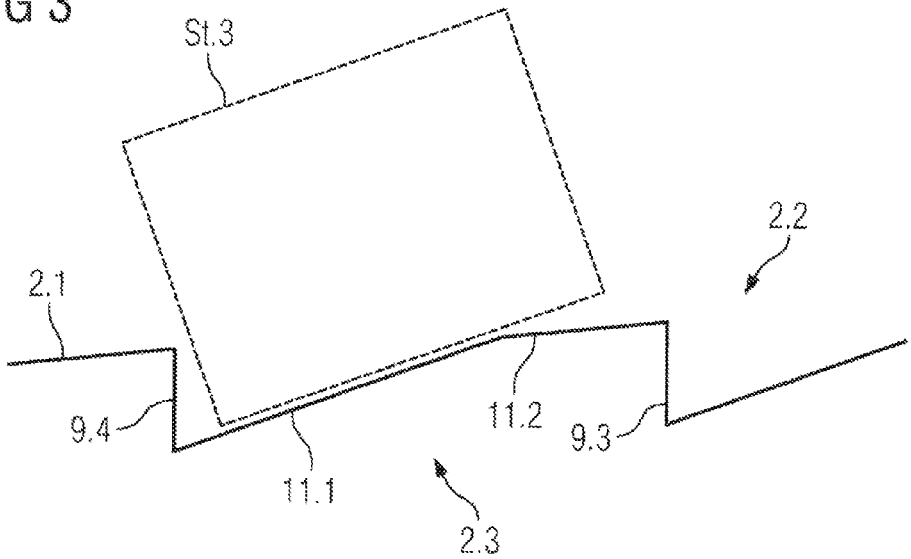
FIG. 3 shows a modification of the configuration from FIG. 2, in which the base has two regions which are inclined to different extents.
Figure 4:
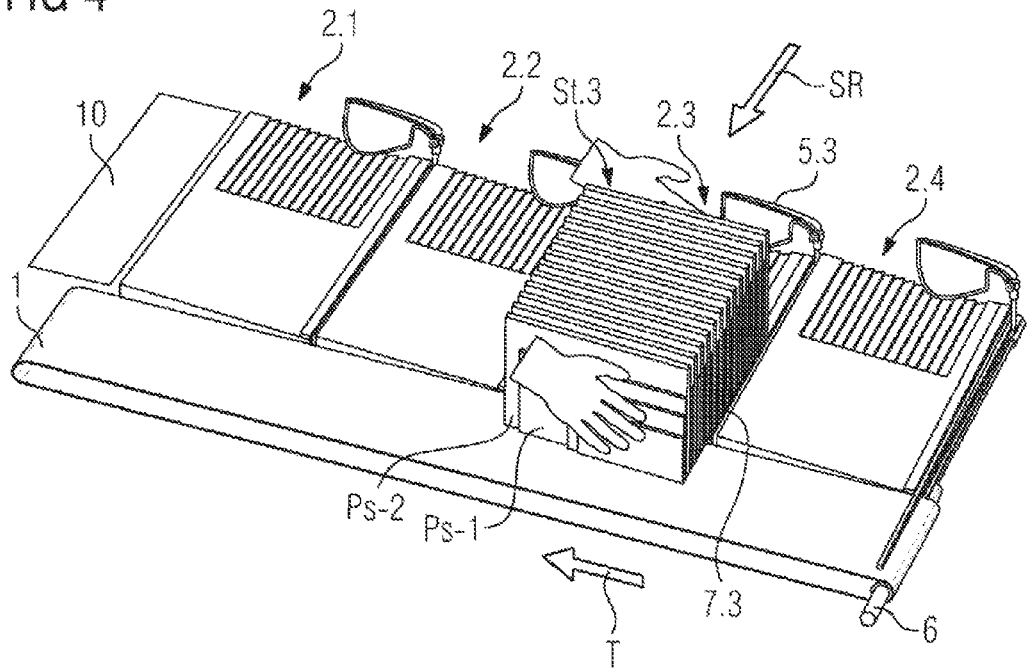
FIG. 4 shows the first step of a method by means of which a stack of items of mail is transferred from an output means onto the conveying belt.
Figure 5:
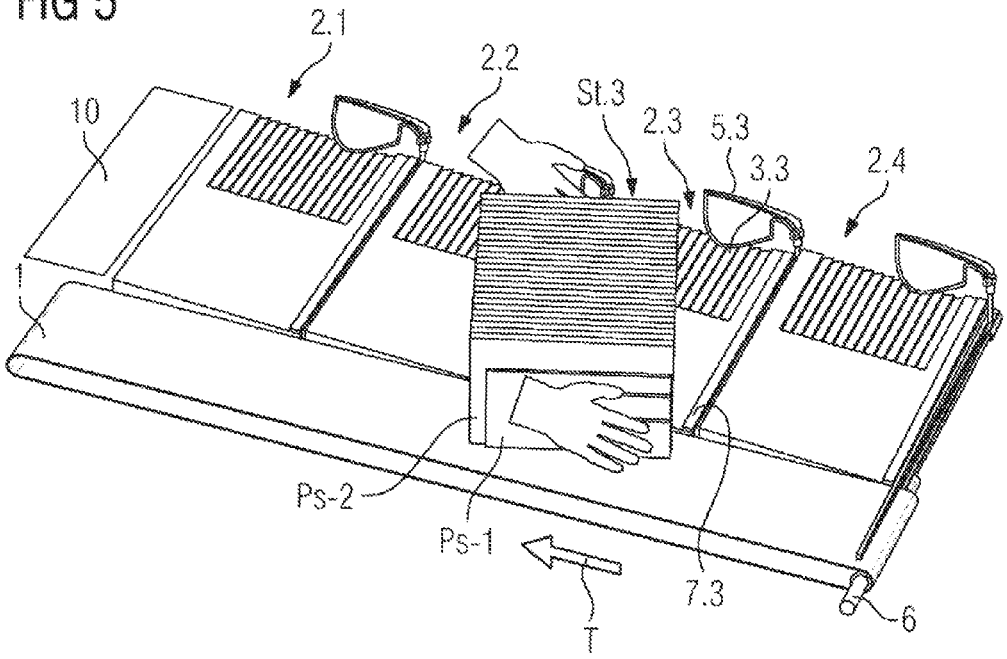
FIG. 5 shows the second step of the method by means of which the stack is transferred from the output means onto the conveying belt.
Figure 6:
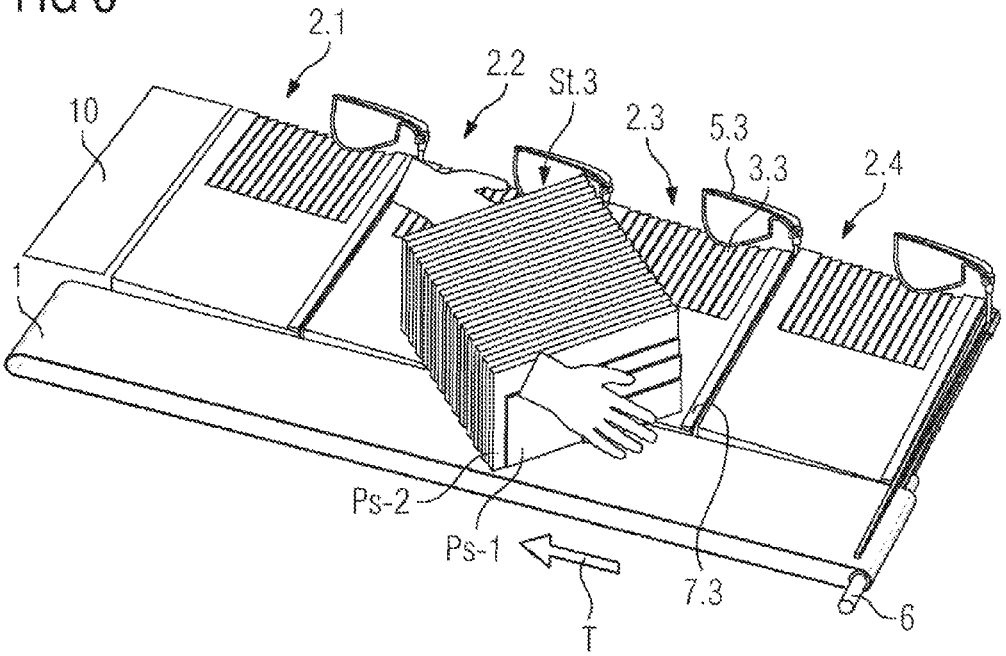
FIG. 6 shows the third step of the method by means of which the stack is transferred from the output means onto the conveying belt.
Figure 7:
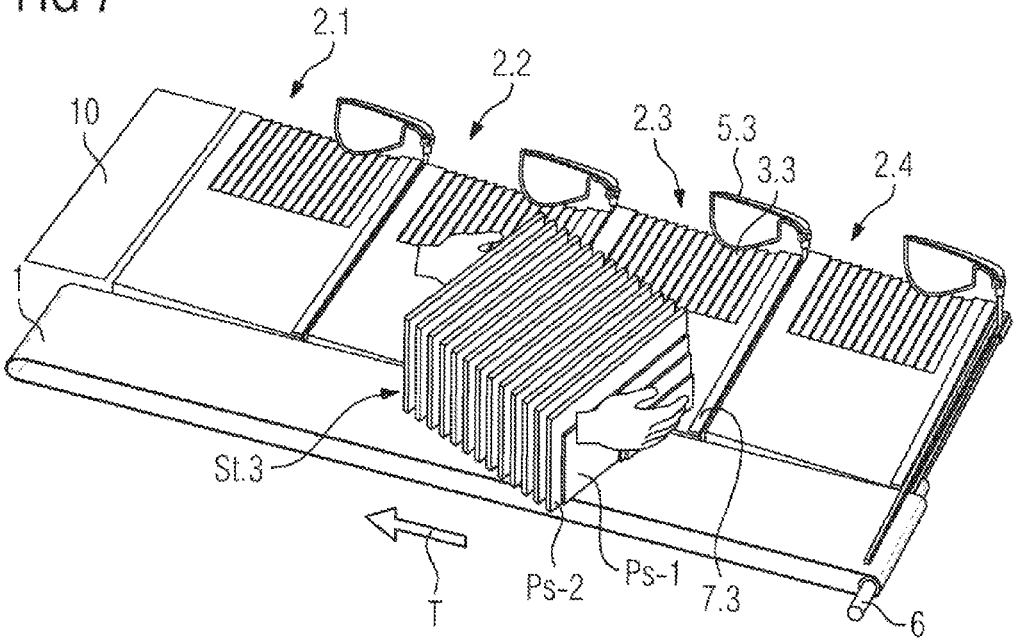
FIG. 7 shows the fourth step of the method by means of which the stack is transferred from the output means onto the conveying belt.
Figure 8:
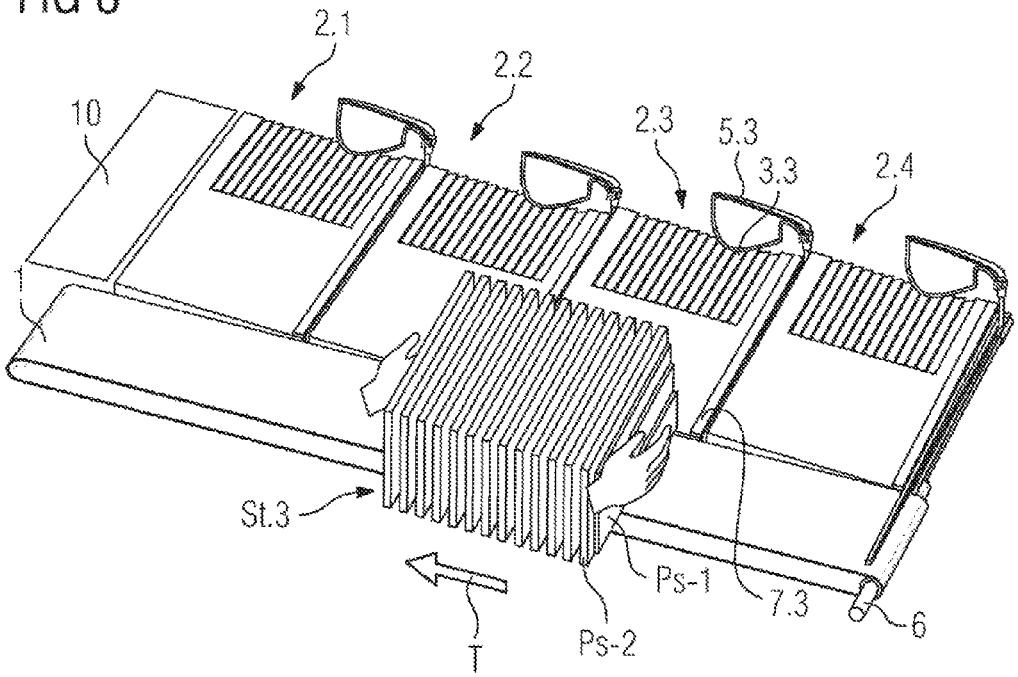
FIG. 8 shows the fifth step of the method by means of which the stack is transferred from the output means onto the conveying belt.

FIG. 3 shows this modification of the configuration of FIG. 2 in schematic form. In FIG. 3, the base has two regions, which are inclined to different extents. The figure illustrates the base of the output means 2.3, which has been subdivided into a relatively steep region 11.1 and a relatively flat region 11.2. The inclination in relation to the horizontal has been exaggerated for reasons of clarity. As a result of this configuration, items of mail in the output means 2.3 are aligned to even better effect along the edge 9.4. The steep region 11.1 causes the items of mail to slide over the base of the output means 2.3, counter to the direction of upward slope A, until they strike against the edge 9.4. However, there is often not enough space—as seen in the vertical direction—in order to incline the entire base in relation to the horizontal to the extent where good alignment is achieved. The region 11.1 is therefore followed by the relatively flat region 11.2.

The base of the output means 2.3 has been subdivided into the two regions 11.1 and 11.2 such that the center of gravity of each item of mail is located above the relatively steep region 11.1. This causes the lower edges to be aligned on the relatively steep region 11.1, rather than on the relatively flat region 11.2.

As already explained, usually a plurality of flat items of mail are discharged into the same output means, that is to say all the items of mail of which the delivery addresses are assigned this output means. Those flat items of mail which were discharged into the same output means form a stack in each case. The stacking direction SR of the stack is perpendicular to the article plane and, in the exemplary embodiment, also perpendicular to the longitudinal direction L. In the example of the figures, those items of mail which were discharged into the output means 2.3 form the stack St.3. Each item of mail is discharged into the respective output means in a stacking direction SR. This stacking direction SR is perpendicular to the transporting direction T and to the direction of upward slope A.

In FIG. 1, in the first instance a relatively small item of mail Ps-1 is discharged into the output means 2.3, this being followed by a relatively large item of mail Ps-2, and then further items of mail. It is indicated that further items of mail of the resulting stack St.3 are also of different sizes. It is also indicated that the inclination of the base of the output means 2.3 causes the items of mail of the stack St.3 to be aligned along the edge 9.4, wherein the edge 9.4 runs between the adjacent output means 2.3 and 2.4.

Each output means, moreover, has a respective supporting component. This supporting component comprises a supporting surface, a connecting member, which is fixed to the supporting surface, and a guide rail. In the exemplary embodiment, the supporting surface and the connecting member, together, are in the form of a paddle. The guide rail runs parallel to the stacking direction SR. The connecting member is fixed to the supporting surface and is able to slide back and forth in the guide rail.

The figures show the paddle 5.1, 5.2, 5.3 and 5.4 and the guide rails 7.1, 7.2, 7.3 and 7.4 of the output means 2.1, 2.2, 2.3 and 2.4. The paddle 5.1 can be displaced back and forth in the stacking direction SR, and in the opposite direction, along the guide rail 7.1, and the same applies to the other three paddles 5.2, 5.3 and 5.4 shown.

FIG. 2 shows the paddle 5.2 with the supporting surface 12.2 and the connecting member 13.2, and a paddle 5.3 with the supporting surface 12.3 and the connecting member 13.3.

The supporting component of the output means prevents the stack of items of mail in the output means from tipping over. The items of mail are discharged into the output means against the paddle.

The growing stack displaces the paddle toward the conveying belt 1, away from the diverter, in the stacking direction SR and thus perpendicularly to the longitudinal direction L.

The connecting member is connected to a restoring component, preferably a spring. The growing stack displaces the paddle counter to the force of the restoring component. The paddle thus pushes the stack once again in the direction of the diverter. This prevents the stack from falling over.

Since the base of each output means slopes in the direction of upward slope A, and has a scale-containing surface in addition, it is difficult for a stack to be displaced counter to the longitudinal direction L, transversely to the stacking direction SR. The stack would have to be displaced up the slope and over the steep edges of the scales. The steep edges between the output means prevent the stack from being displaced in the longitudinal direction L from one output means into the adjacent output means.

A conveying means is adjacent to the row or rows of output means such that the distance between the output means 2.1, 2.2, etc. and the conveying means is small, e.g. less than 10 cm. The distance is small enough for it to be possible for a stack of items of mail to be transferred easily from the row of output means onto the conveying means.

The conveying means comprises the horizontal endless conveying belt 1. This conveying belt 1 extends in the longitudinal direction L along a row of output means. The conveying belt 1 is configured in order to transport a stack of items of mail from an output means back to the feeding means counter to the longitudinal direction L, to be precise in the transporting direction T. The sorting installation is thus able to implement "n pass sorting", that is to say it is able to sort the items of mail in a number of sorting cycles. Since the sorting installation sorts using a number of sorting cycles, the sorting installation is able to sort to considerably more delivery addresses than it has output means. Methods of "n pass sorting" are described, for example, in EP 948416 B1, EP 1425113 B1 and US 2005/0205473 A1.

A stack of items of mail has to be removed from an output means 2.1, 2.2, 2.3, etc. and transferred onto the conveying belt 1 when at least one of the following two requirements have been met:

- the output means has been filled with items of mail up to a predetermined filling level.
- a predetermined point in time has been reached, this time depending on a time plan for further transportation or for the delivery of items of mail.

In the exemplary embodiment, for this purpose, each stack is rotated such that the stack is oriented in the longitudinal direction L following rotation and is transferred onto the conveying belt 1 following rotation.

In a first embodiment, the stack is transferred such that that item of mail which was the final item of mail to be discharged into the output means is at the front, as seen in the transporting direction T, following transfer and is thus the first to reach the feeding means. This means that the items of mail are in reverse order as they reach the feeding means in which they were discharged into the output means.

FIGS. 4 to 8 depict the transfer according to this first embodiment. The stack St.3 is transferred from the output means 2.3 onto the conveying belt 1. That item of mail Ps-1 which was the first to be discharged into the output means 2.3 is located at the end of the stack St.3 following transfer, that is to say it is the final item of mail in the stack St.3—as seen in the transporting direction T. For transfer purposes, use is additionally made of the output means 2.2.

In this first embodiment, the direction of upward slope A is oriented in the direction counter to the longitudinal direction L, that is to say in the direction of the feeding means. In order to empty an output means 2.3, the method which will be described hereinbelow requires the output means 2.2 which is located directly behind 2.3—as seen in the direction of upward slope A—to be empty. The stack St.3 of items of mail is removed from the output means 2.3 as follows: the stack St.3 is gripped from both sides, to be precise either by an operator or by a handling machine. The stack St.3 is rotated about a vertical axis of rotation, which runs preferably more or less centrally through the first-discharged item of mail in the stack St.3. The stack St.3 is rotated such that a rear portion of the stack St.3 passes onto the adjacent output means 2.2. The stack St.3 here slides in the direction of upward slope A over the base of the two output means 2.2 and 2.3. The force at which rotation is executed is sufficient in order to push the stack St.3 over the region with the scale-containing surface. The edge 9.3 between the two output means 2.3 and 2.2 does not obstruct the rotation because the stack St.3 is rotated in the direction in which the edge 9.3 slopes down. The stack St.3 is moved onto the conveying belt 1 by the rotation such that the first-discharged item of mail is located at the rear, and the last-discharged item of mail is located at the front, of the conveying belt—as seen in the transporting direction T. The conveying belt 1 transports the stack St.3 to the feeding means.

In a second embodiment, in contrast, the stack St.3 is transferred such that the first-discharged item of mail is at the front, as seen in the transporting direction T, following transfer and is the first to reach the feeding means. As a result, the items of mail reach the feeding means in the same order in which they were discharged into the output means. In the second embodiment, the direction of upward slope A is oriented in the longitudinal direction L, that is to say away from the feeding means. In this embodiment, once again, use is made, for the rotation, of the base of an adjacent output means located directly behind 2.3—as seen in the direction of upward slope A. However, this adjacent output means is likewise located behind 2.3 as seen in the longitudinal direction L.

Rotation is thus executed in the manner described above.

The output means 2.1, 2.2, etc. are arranged one behind the other—as seen in the longitudinal direction L. They are emptied preferably in the order which is predetermined by the longitudinal direction L, that is to say such that in the first instance the first output means 2.1, as seen in the longitudinal direction L, is emptied, this being followed by the second output means 2.2, and so on. Accordingly, in the first instance the output means 2.1 is emptied, this being followed by the output means 2.2, then the output means 2.3, and so on. The output means 2.2 is already empty when the output means 2.3 is emptied in the manner just described. In order for it also to be possible to empty the first output means 2.1 in the manner just described, a planar work surface 10 is preferably arranged in front of the first output means 2.1—as seen in the longitudinal direction L. This work surface 10 is narrower than the first output means 2.1, that is to say it is only wide enough to rotate the stack St.1 from the first output means 2.1.

As explained above, a growing stack St.3 displaces a supporting component in the form of a paddle, e.g. the paddle 5.3 of the output means 2.3, in the stacking direction SR toward the conveying belt 1 of the conveying means. The paddle 5.3 would be in the way during transfer of the stack St.3. Therefore, the paddle is moved, prior to the stack being transferred, into a position in which the paddle is located behind the stack St.3—as seen in the stacking direction SR—that is to say the stack St.3 is located between the paddle and the conveying belt 1 and the paddle is located between the stack and the discharging apparatus.

Each paddle comprises a supporting surface and a connecting member, which is fixed to the supporting surface. The connecting member slides back and forth in a guide rail. A restoring component attempts to move the paddle away from the conveying belt 1, counter to the stacking direction SR, and therefore the paddle is pushed against a stack St.3.

FIGS. 9 to 14 show a preferred configuration of how a paddle 5.1, 5.2, etc. is drawn back. This is explained by way of the example of the paddle 5.3 with the supporting surface 12.3 and the connecting member 13.3.

In the preferred configuration, the supporting surface 12.3 can be rotated relative to the connecting member 13.3 about two axes of rotation: about a horizontal axis of rotation D1, which runs parallel to the stacking direction SR, and about a vertical axis of rotation D2, which is perpendicular to the axis of rotation D1 and to the stacking direction SR.

Figure 9:
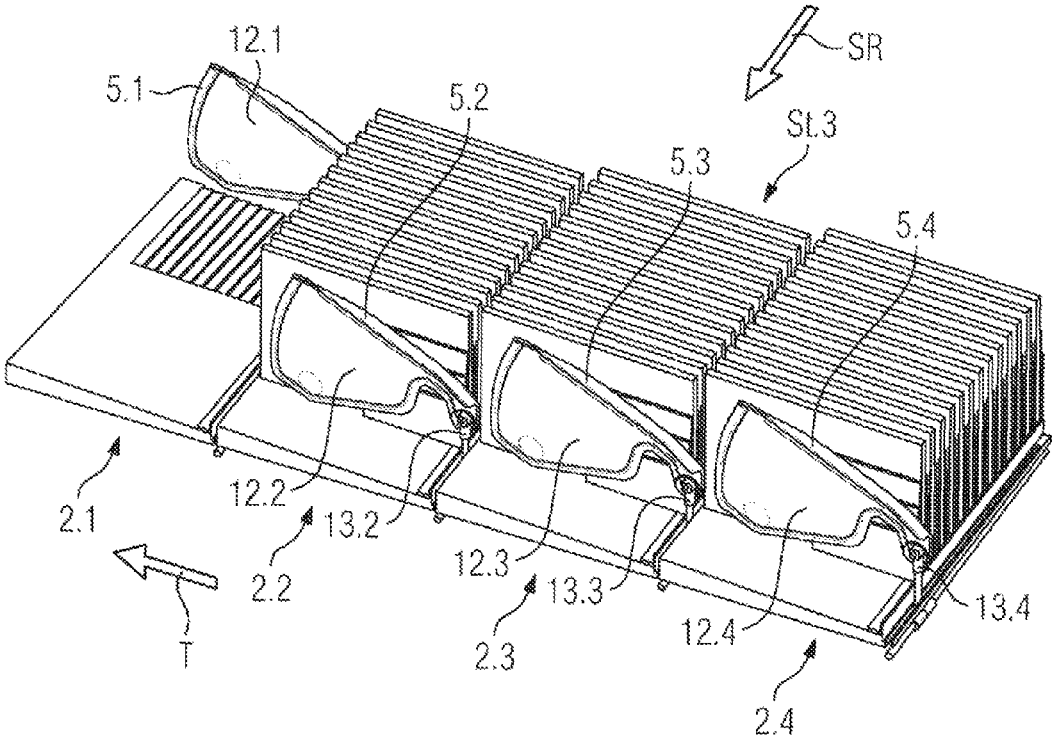
FIG. 9 shows the first step for drawing back the paddle.
Figure 10:
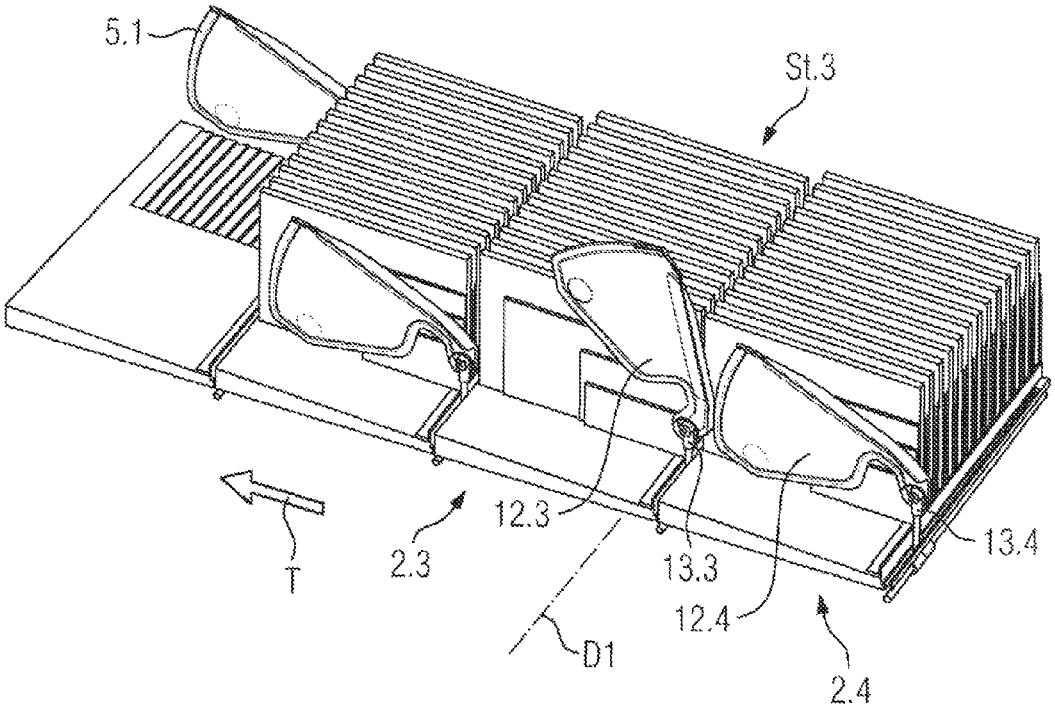
FIG. 10 shows the second step for drawing back the paddle: the supporting surface is swung upward by rotation about a horizontal axis of rotation.

As a comparison of FIGS. 9 and 10 shows, in the first instance the supporting surface 12.3 of the paddle 5.3 is swung upwards, by the supporting surface 12.3 being rotated relative to the connecting member 13.3 about the horizontal axis of rotation D1. The paddle 5.3 is still located between the stack St.3 and the conveying belt 1.

Figure 11:
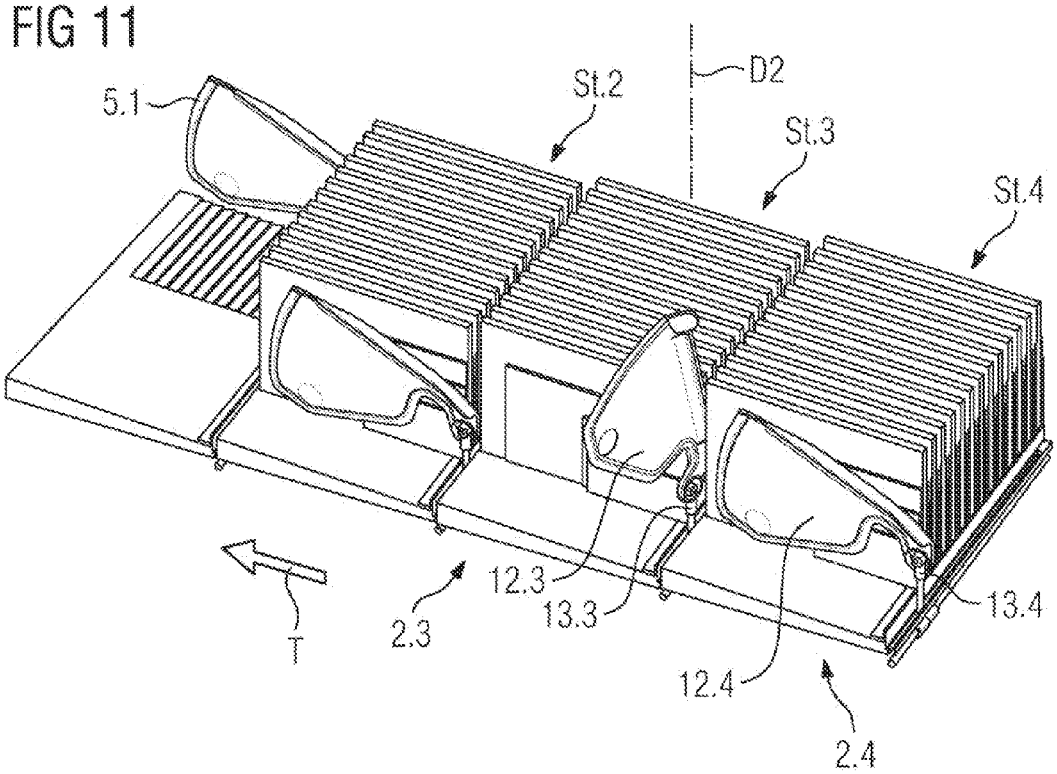
FIG. 11 shows the third step for drawing back the paddle: the supporting surface is rotated about a vertical axis of rotation.

Then the supporting surface 12.3 is rotated relative to the connecting member 13.1 about a vertical axis of rotation D2. This situation is shown in FIG. 11. The supporting surface 12.3 is then oriented in the stacking direction SR. Since the supporting surface 12.3 was previously rotated about the horizontal axis of rotation D1, the stack St.3 in the output means 2.3 does not obstruct the rotation about the vertical axis of rotation D2.

Figure 12:
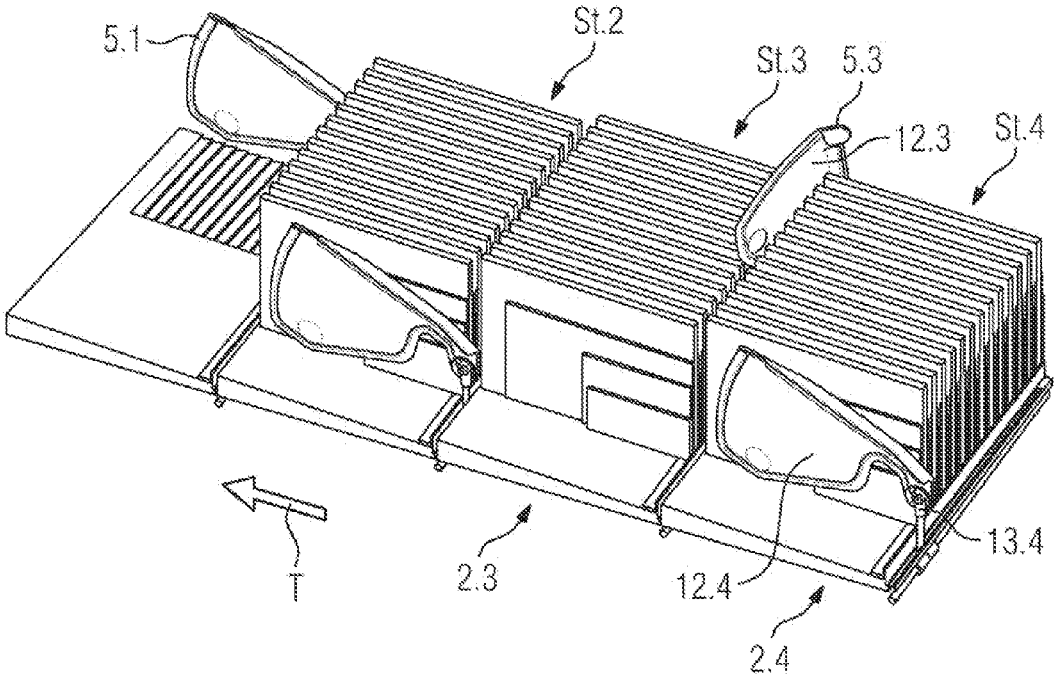
FIG. 12 shows the fourth step for drawing back the paddle: the paddle is pushed back.

Then the paddle 5.3 is pushed back counter to the stacking direction SR. The connecting member 13.3 here slides in the guide rail. The restoring component here moves the connecting member 13.3. FIG. 12 shows the pushed-back paddle 5.3. The paddle 5.3 is then located between the stack St.3 in the output means 2.3 and the stack St.4 in the adjacent output means 2.4.

Figure 13:
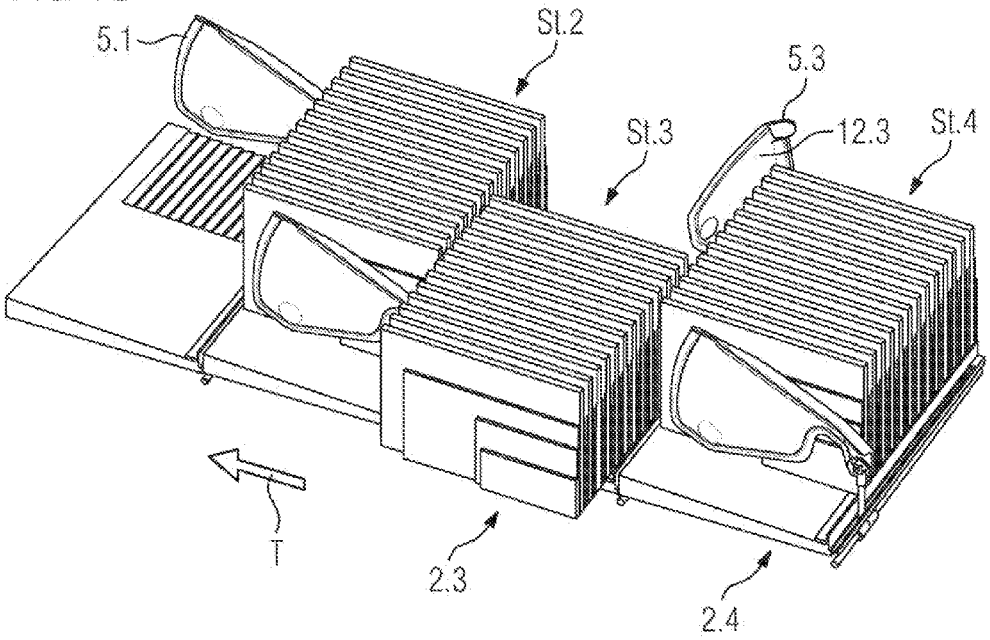
FIG. 13 shows the fifth step for drawing back the paddle: the stack is pushed out of the output means.

The stack St.3 is then displaced out of the output means 2.3, to be precise beginning with a linear movement, in the stacking direction SR. The result of this displacement is shown in FIG. 13.

Figure 14:
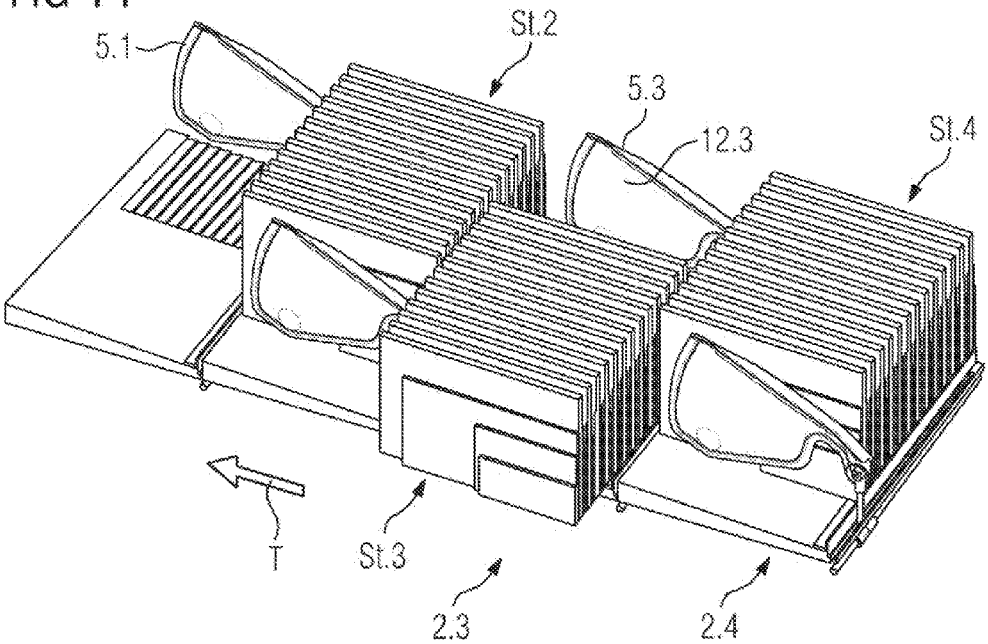
FIG. 14 shows the sixth step for drawing back the paddle.

The supporting surface 12.3 is then moved once again into the starting position relative to the connecting member 13.2. For this purpose, the supporting surface is displaced both about the horizontal axis of rotation D1 and about the vertical axis of rotation D2. This results in the situation which is shown in FIG. 14.

LIST OF DESIGNATIONS

| Designation | Meaning |
|---|---|
| 1 | Conveying belt of the conveying means |
| 2.1, 2.2, etc. | Output means |
| 3.1, 3.2, etc. | Scale-containing regions of the bases of the output means 2.1, 2.2, etc. |
| 4.1, 4.2, etc. | Scale-free regions of the bases of the output means 2.1, 2.2, etc. |
| 5.1, 5.2, etc. | Paddles of the supporting components of the output means |
| 6 | Guide roller of the conveying belt 1 |
| 7.1, 7.2, etc. | Guide rails of the supporting components of the output means |
| 8.1, 8.2 | Scales in the scale-containing region 3.1, 3.2, etc. |
| 9.1, 9.2 | Edges between the bases of two adjacent output means |
| 10 | Planar work surface alongside the first output means 2.1 |
| 11.1 | Relatively steep region of the base of the output means 2.3 |
| 11.2 | Relatively flat region of the base of the output means 2.3 |
| 12.1, 12.2, etc. | Supporting surfaces of the paddle 5.1, 5.2, etc. |
| 13.1, 13.2, etc. | Connecting members of the paddles 5.1, 5.2, etc. |
| A | Direction of upward slope |
| D1 | Horizontal axis of rotation about which the supporting surface 12.3 can be rotated relative to the connecting member 13.3 |
| D2 | Vertical axis of rotation about which the supporting surface 12.3 can be rotated relative to the connecting member 13.3 |
| L | Longitudinal direction parallel to the longitudinal axis |
| Ps-1 | That item of mail in the stack St.3 which was the first to be discharged into the output means 2.3 |
| Ps-2 | That item of mail in the stack St.3, which was the second to be discharged into the output means 2.3 |
| SR | Stacking direction |
| St.3 | Stack of flat items of mail which was discharged into the output means 2.3 |
| T | Transporting direction, in which the conveying belt 1 transports a stack |

The invention claimed is:

1. A sorting installation for sorting flat articles, the sorting installation comprising:

an arrangement with at least two output devices disposed one behind another along a longitudinal axis, a discharging apparatus configured to discharge each of the flat articles to be sorted into a respective one of said output devices and to arrange the flat articles discharged into one and the same output device in a stack extending in a stacking direction;

each of said output devices having a base sloping upward relative to horizontal in a direction of upward slope;

said direction of upward slope being perpendicular to said stacking direction and parallel to the longitudinal axis; and an edge formed between respective bases of two mutually adjacent output device of said arrangement, said edge having a vertical or oblique downward slope in the direction of upward slope.

2. The sorting installation according to claim 1, wherein said base of at least one output device has a region with a surface formed with scales, and said scales of said region are formed to render it difficult for an article located in said output device to be displaced in the direction of upward slope.

3. The sorting installation according to claim 2, wherein said base of said at least one output device is formed with a first region with said scales, and, following said first region in the stacking direction, with a second region with a smooth surface.

4. The sorting installation according to claim 1, wherein said base of at least one output device has a relatively steep region and a relatively flat region, and wherein:

said relatively flat region is located behind said relatively steep region in the direction of upward slope; and said relatively steep region is inclined in relation to the horizontal to a greater extent than said relatively flat region.

5. The sorting installation according to claim 1, which further comprises a conveying device and a feeding device, and wherein:

said feeding device is configured to feed articles to the sorting installation; and said conveying device is configured to transport a stack of flat articles to said feeding device.

6. The sorting installation according to claim 5, wherein said conveying device extends along the longitudinal axis and is disposed adjacent to said bases of said output device.

7. The sorting installation according to claim 1, wherein said base of said at least one output device slopes up relative to the horizontal by 2 degrees to 6 degrees, in the direction of upward slope.

8. The sorting installation according to claim 1, which further comprises a planar work surface, and wherein said work surface is disposed in front of said first output device or behind said final output device and said work surface is adjacent to, and flush with, said base of the first output device or final output device, as seen along the longitudinal axis.

9. The sorting installation according to claim 1, wherein at least one of said output devices comprises a supporting component, said supporting component being displaceably mounted back and forth along a displacement path located between said base of said at least one output device and said base of an adjacent said output device of said arrangement; and said supporting component having a supporting surface extending in a supporting plane; and said supporting surface can be moved into a supporting position in which said supporting plane of said supporting surface is perpendicular to said stacking direction and said supporting surface is located behind a stack in said output device, as seen in the stacking direction.

10. The sorting installation according to claim 9, wherein said supporting component has a connecting member mounted for displacement back and forth in the displacement path, and wherein said supporting surface:

is pivotable relative to said connecting member; and is movable by pivoting relative to said connecting member out of the supporting position into a displacement position, in which said supporting surface can be pushed past a stack in said output device to which said supporting component belongs.

11. The sorting installation according to claim 10, wherein:

said supporting surface is mechanically connected to said connecting member to enable said supporting surface to be rotated relative to said connecting member about a vertical axis of rotation, wherein, following rotation thereof, said supporting plane of said supporting surface is arranged parallel to said stacking direction; and wherein said vertical axis of rotation is perpendicular to said stacking direction.

12. The sorting installation according to claim 10, wherein:

said supporting surface is mechanically connected to aid connecting member to enable said supporting surface to be rotated relative to said connecting member about a horizontal axis of rotation;

wherein said horizontal axis of rotation runs parallel to said stacking direction.

13. In a sorting plant for processing flat items of mail, the sorting installation according to claim 1 installed therein for sorting flat items of mail.

14. A method of sorting flat articles, which comprises:

providing a sorting installation with a conveying device and an arrangement having two or more output devices arranged one behind the other, along a longitudinal axis, with each output device of the arrangement having a base;

the base of each output device sloping upward relative to the horizontal, in a direction of upward slope running parallel to the longitudinal axis; and wherein an edge is formed between the bases of two adjacent output devices, the edge sloping vertically or obliquely downward in the direction of upward slope;

discharging each flat article to be sorted into a respective one of the output devices and thereby forming a stack in the respective output device extending in a stacking direction perpendicular to the longitudinal axis;

moving each resulting stack of flat articles out of the respective output device onto the conveying device by:

rotating the stack about an axis of rotation perpendicular to the stacking direction;

for rotating the stack, using the base of an adjacent output device, as seen in the direction of upward slope; and displacing the rotated stack onto the conveying device by way of a linear movement; and subsequently transporting each stack of flat articles away with the conveying device.

* * * * *